US008991284B2

(12) United States Patent
Castle

(10) Patent No.: US 8,991,284 B2
(45) **Date of Patent: *Mar. 31, 2015**

(54) TORQUE WRENCH WITH "DEADBAND" ELIMINATION AND IMPROVED TORQUE MONITORING SYSTEM

(71) Applicant: George L. Castle, Terryville, CT (US)

(72) Inventor: George L. Castle, Terryville, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/888,933

(22) Filed: May 7, 2013

(65) Prior Publication Data

US 2014/0007747 A1 Jan. 9, 2014

Related U.S. Application Data

(63) Continuation of application No. 12/658,848, filed on Feb. 16, 2010, now Pat. No. 8,434,389.

(60) Provisional application No. 61/207,673, filed on Feb. 13, 2009.

(51) Int. Cl.

| | |
|---|---|
| ***B25B 23/14*** | (2006.01) |
| ***B25B 17/02*** | (2006.01) |
| ***B25B 23/142*** | (2006.01) |

(52) U.S. Cl.

CPC ..... *B25B 23/14* (2013.01); *B25B 17/02* (2013.01); *B25B 23/1425* (2013.01)

USPC ..... 81/57.14; 81/467

(58) Field of Classification Search

USPC ..... 81/57.14, 57, 57.3, 57.31, 467, 479

See application file for complete search history.

(56) References Cited

U.S. PATENT DOCUMENTS

| | | | | |
|---|---|---|---|---|
| 2,961,904 | A | 11/1960 | Sergan | |
| 3,472,083 | A * | 10/1969 | Schnepel | 81/57 |
| 3,604,718 | A | 9/1971 | Becker | |
| 3,713,068 | A * | 1/1973 | Talmo | 338/2 |
| 4,055,080 | A * | 10/1977 | Farr et al. | 73/862.21 |
| 4,558,601 | A | 12/1985 | Stasiek et al. | |
| 4,845,998 | A | 7/1989 | Demartelaere et al. | |
| 4,976,133 | A | 12/1990 | Pohl | |
| 5,056,384 | A | 10/1991 | Sergan | |
| 5,203,239 | A | 4/1993 | Sergan et al. | |
| 5,278,274 | A | 1/1994 | Verhelst et al. | |
| 5,388,478 | A | 2/1995 | Castle | |
| 5,404,775 | A * | 4/1995 | Abe | 81/467 |
| 5,616,095 | A * | 4/1997 | Pruitt | 81/57.31 |
| 7,156,003 | B2 | 1/2007 | Cole | |
| 7,490,535 | B2 * | 2/2009 | Ha | 81/475 |
| 2008/0271580 | A1 | 11/2008 | Marie et al. | |

FOREIGN PATENT DOCUMENTS

| | | |
|---|---|---|
| JP | 9-141567 | 6/1997 |
| JP | 2002-120160 | 4/2002 |

* cited by examiner

*Primary Examiner* — Hadi Shakeri
(74) *Attorney, Agent, or Firm* — Pandiscio & Pandiscio

(57) ABSTRACT

A torque wrench comprising a hollow housing comprising an outer wall and an inner wall each having a proximal end and a distal end, the inner wall being spaced from the outer wall so as to provide a gap therebetween, the proximal end of the outer wall being connected to the proximal end of the inner wall, and the distal end of the outer wall being configured to engage a workpiece housing; a mechanical multiplier disposed within the inner wall, the mechanical multiplier comprising a torque input shaft and a torque output shaft, the mechanical multiplier being connected to the inner wall, and the torque output shaft being configured to engage a workpiece fastener; and a torque monitoring system comprising at least one strain gauge mounted to the inner wall proximally of the midpoint of the inner wall.

13 Claims, 18 Drawing Sheets

TORQUE WRENCH WITH "DEADBAND" ELIMINATION AND IMPROVED TORQUE MONITORING SYSTEM

REFERENCE TO PENDING PRIOR PATENT APPLICATION

This patent application is a continuation of prior U.S. patent application Ser. No. 12/658,848, filed Feb. 16, 2010, now U.S. Pat. No. 8,434,389, by George L. Castle for TORQUE WRENCH WITH "DEADBAND" ELIMINATION AND IMPROVED TORQUE MONITORING SYSTEM, which in turn claims benefit of prior U.S. Provisional Patent Application Ser. No. 61/207,673, filed Feb. 13, 2009 by George L. Castle for TORQUE WRENCH WITH "DEADBAND" ELIMINATION AND IMPROVED TORQUE MONITORING SYSTEM.

FIELD OF THE INVENTION

This invention relates to mechanical tools in general, and more particularly to torque wrenches.

BACKGROUND OF THE INVENTION

A torque wrench is a tool which is used to apply a precise amount of torque to a fastener such as a nut or a bolt. Applying a precise amount of torque to a fastener can be important in many situations, e.g., such as when installing or removing the main rotor shaft of a helicopter.

In general, the torque wrench comprises a long lever arm extending between the wrench handle and the wrench head. A torque monitoring system is incorporated in the torque wrench in order to show the operator exactly how much torque is being applied to the fastener. The torque monitoring system is typically incorporated in the long lever arm or in the wrench head.

By way of example but not limitation, in a beam-type torque wrench, the long lever arm is generally made of a material which bends elastically in response to an applied load. By comparing the extent to which the long lever arm deflects (e.g., by comparison to a smaller, non-bending bar also connected to the wrench head), the amount of torque being applied to the fastener can be determined.

Many other types of torque wrenches are well known in the art, some utilizing pressure transducers or strain gauges to measure lever arm deflection or wrench head deformation, and some including mechanical multipliers in the wrench head for amplifying the amount of torque applied to the fastener.

It can be technically challenging to provide a torque wrench having a torque monitoring system which is highly accurate across a wide range of different torque levels. By way of example but not limitation, in many prior art designs, the torque monitoring system provided on a torque wrench might be reliable to + or −3% at low torque levels (e.g., approximately 100 ft-lbs), but only reliable to + or −10% at high torque levels (e.g., approximately 1000 ft-lbs). In this respect it will also be appreciated that higher error ranges at higher torque levels increase the possibility of accidentally over-torqueing a fastener at the higher torque ranges, sometimes with catastrophic results (e.g., fastener breakage, workpiece damage, etc.). Stated another way, if a torque monitoring system is reliable to + or −3% at 100 ft-lbs, the maximum accidental over-torqueing at 100 ft-lbs of torque is only 3 ft-lbs, whereas if a torque monitoring system is reliable to + or −10% at 1000 ft-lbs, the maximum accidental over-torqueing at 1000 ft-lbs of torque is 100 ft-lbs. For this reason, it is generally desirable that the torque monitoring system be as accurate as possible across the full range of torque levels which will be encountered by the torque wrench.

It has also been found that, when using strain gauges and the like to monitor torque levels, the positioning of the strain gauges on the torque wrench can make a large difference in the accuracy of the torque monitoring system, particularly at higher torque levels. This is because various portions of the torque wrench may deform at different rates under different torque loads. Thus, for example, where the torque measuring system uses a strain gauge applied to the cylindrical outer wall of the wrench head to measure applied torque, one level of accuracy may be achieved, and where the torque measuring system uses a strain gauge applied to a flange mounted to the cylindrical outer wall of the wrench head to measure applied torque, another level of accuracy may be achieved. And in either case, this level of accuracy tends to differ significantly across the spectrum of applied torque.

In addition to the foregoing, it has also been found that, with prior art torque wrenches, and particularly with prior art torque wrenches which include mechanical multipliers for amplifying the amount of torque applied to the fastener, some residual forces typically remain on the torque wrench after torque is no longer being applied to the torque wrench. As a result, the torque monitoring system still reports torque on the torque wrench even when no torque is being applied to the torque wrench. It is believed that these residual forces are the result of internal friction, and parts binding, within the torque wrench.

Furthermore, when the application of torque in one direction (e.g., clockwise torque) is replaced by the application of torque in the opposite direction (e.g., counterclockwise torque), the newly-applied torque initially works to nullify the residual opposing torque already stored in the torque wrench. As a result, the torque monitoring system will report that no torque is being applied to the torque wrench, when in fact torque is being applied to the torque wrench. Thus, where the torque wrench stores torque in the torque wrench, there is a "deadband" effect whenever the application of torque in one direction is replaced by the application of torque in another direction. This "deadband" effect essentially undermines the accuracy of the torque monitoring system, since there is a disparity between the level of torque being applied to the torque wrench and the level of torque being reported by the torque monitoring system. Significantly, this disparity is typically non-linear, leading to larger disparities at higher torque levels.

In practice, it is generally necessary, whenever changing the direction of applied torque, to perform a "zero shift" for the torque wrench before applying the opposite torque, in order for the torque monitoring system to accurately register the new torque being applied to the torque wrench. This need to provide a "zero shift" before changing the direction of torque is of significant concern, since the "zero shift" operation is time-consuming and, due to the non-linearity issues discussed above, difficult to apply precisely across a wide range of torque levels. Furthermore, in practice, it has been found that field personnel frequently fail to perform the aforementioned "zero shift" operation, thereby resulting in the torque monitoring system inaccurately reporting the level of torque being applied by the torque wrench.

SUMMARY OF THE INVENTION

The present invention provides a novel torque wrench combining "deadband" elimination with improved torque monitoring. This new and improved construction comprises, among other things, a mechanical multiplier for converting an input torque into a greater output torque, and a hollow housing for receiving the mechanical multiplier. The mechanical multiplier is connected to the hollow housing via a loose, non-binding connection (e.g., a loose, non-binding spline connection) so that the aforementioned "deadband" effect is eliminated. Furthermore, the hollow housing is formed with a cylindrical inner wall as well as a cylindrical outer wall, with the cylindrical inner wall being spaced from the cylindrical outer wall, and with the one or more strain gauges being mounted to this cylindrical inner wall so as to provide a highly accurate torque monitoring system. Thus, the present invention provides a novel torque wrench combining "deadband" elimination with improved torque monitoring.

Due to its unique construction, the torque wrench of the present invention provides accurate torque readings in a substantially linear fashion throughout the full range of the torque wrench, and these readings are of increased accuracy throughout the torque range. By way of example but not limitation, a torque wrench formed in accordance with the present invention is typically accurate to + or −1% at low torque levels (e.g., 100 ft-lbs) and accurate to + or −1% at high torque levels (e.g., 1000 ft-lbs). This is a dramatic improvement over the prior art.

In one preferred form of the invention, there is provided a torque wrench comprising:

a hollow housing comprising an outer wall having a proximal end and a distal end, and an inner wall having a proximal end and a distal end, the inner wall being spaced from the outer wall so as to provide a gap therebetween, the proximal end of the outer wall being connected to the proximal end of the inner wall, and the distal end of the outer wall being configured to engage a workpiece housing; and a mechanical multiplier for disposition within the inner wall of the hollow housing, the mechanical multiplier comprising a torque input shaft and a torque output shaft, the mechanical multiplier being connected to the inner wall of the hollow housing by a loose, non-binding connection, and the torque output shaft being configured to engage a workpiece fastener.

In another form of the invention, there is provided a torque wrench comprising:

a hollow housing comprising an outer wall having a proximal end and a distal end, and an inner wall having a proximal end and a distal end, the inner wall being spaced from the outer wall so as to provide a gap therebetween, the proximal end of the outer wall being connected to the proximal end of the inner wall, and the distal end of the outer wall being configured to engage a workpiece housing;

a mechanical multiplier for disposition within the inner wall of the hollow housing, the mechanical multiplier comprising a torque input shaft and a torque output shaft, the mechanical multiplier being connected to the inner wall of the hollow housing, and the torque output shaft being configured to engage a workpiece fastener; and a torque monitoring system comprising at least one strain gauge mounted to the inner wall of the hollow housing proximally of the midpoint of the inner wall.

In another form of the invention, there is provided a method for applying torque to a workpiece fastener disposed adjacent to a workpiece housing, the method comprising:

providing a torque wrench comprising:

a hollow housing comprising an outer all having a proximal end and a distal end, and an inner wall having a proximal end and a distal end, the inner wall being spaced from the outer wall so as to provide a gap therebetween, the proximal end of the outer wall being connected to the proximal end of the inner wall, and the distal end of the outer wall being configured to engage a workpiece housing; and a mechanical multiplier for disposition within the inner wall of the hollow housing, the mechanical multiplier comprising a torque input shaft and a torque output shaft, the mechanical multiplier being connected to the inner wall of the hollow housing by a loose, non-binding connection, and the torque output shaft being configured to engage a workpiece fastener;

mounting the torque wrench to the workpiece so that the distal end of the outer wall of the housing engages a workpiece housing, and the torque output shaft engages a workpiece fastener; and applying torque to the torque input shaft.

In another form of the invention, there is provided a method for applying torque to a workpiece fastener disposed adjacent to a workpiece housing, the method comprising:

providing a torque wrench comprising:

a hollow housing comprising an outer wall having a proximal end and a distal end, and an inner wall having a proximal end and a distal end, the inner wall being spaced from the outer wall so as to provide a gap therebetween, the proximal end of the outer wall being connected to the proximal end of the inner wall, and the distal end of the outer wall being configured to engage a workpiece housing;

a mechanical multiplier for disposition within the inner wall of the hollow housing, the mechanical multiplier comprising a torque input shaft and a torque output shaft, the mechanical multiplier being connected to the inner wall of the hollow housing, and the torque output shaft being configured to engage a workpiece fastener; and a torque monitoring system comprising at least one strain gauge mounted to the inner wall of the hollow housing proximally of the midpoint of the inner wall;

mounting the torque wrench to the workpiece so that the distal end of the outer wall of the housing engages a workpiece housing, and the torque output shaft engages a workpiece fastener; and applying torque to the torque input shaft.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

Looking first at FIGS. 1-4, there is shown a novel torque wrench 5 formed in accordance with the present invention.

Figure 11:
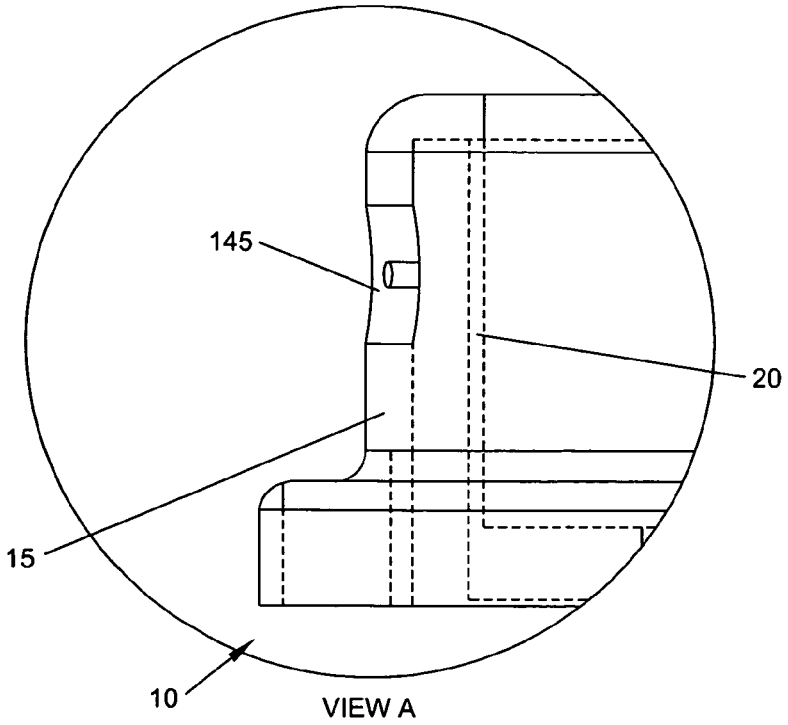
Figure 11A:
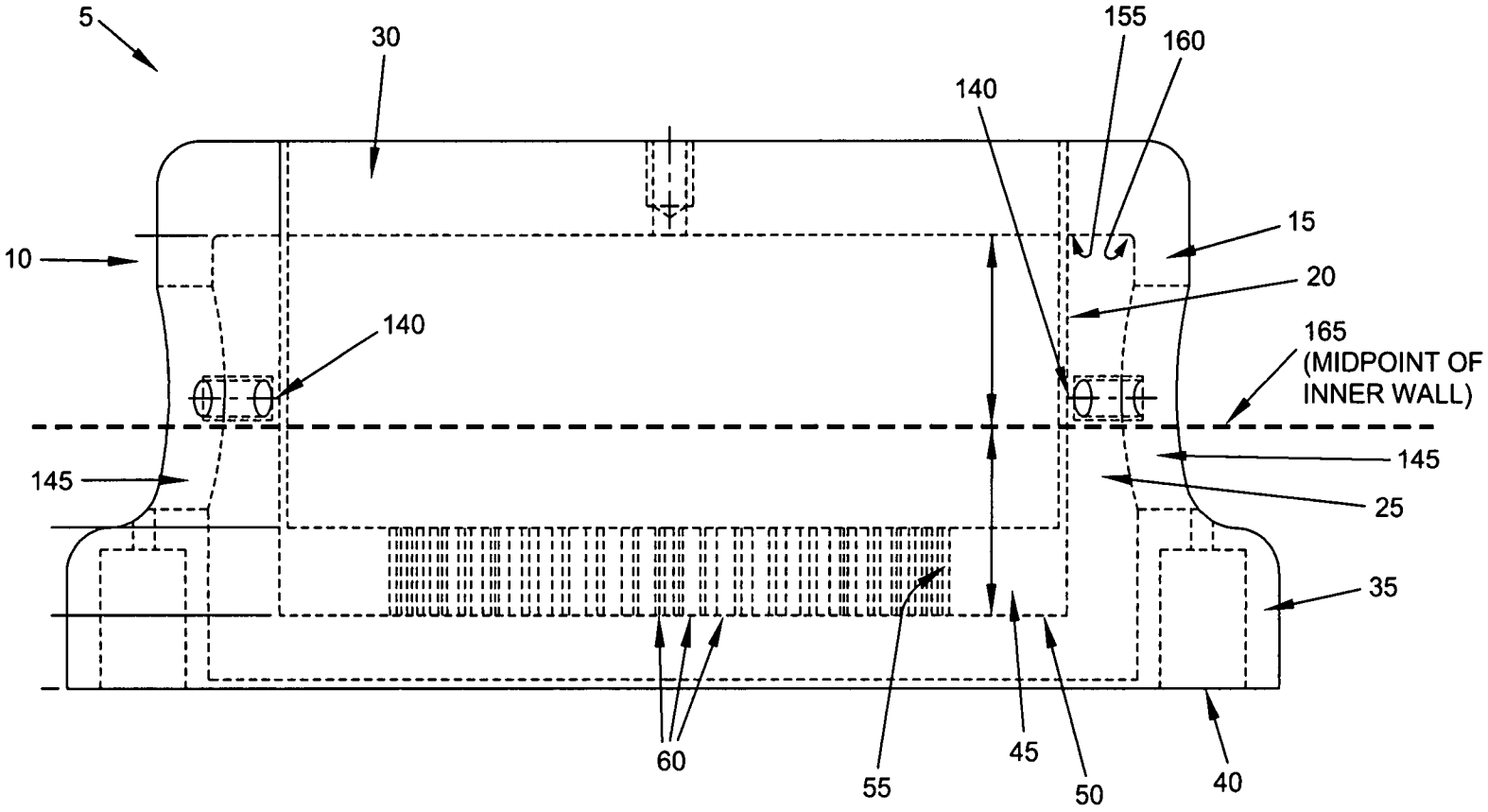

Looking next at FIGS. 5-11 and 11A, torque wrench 5 generally comprises a hollow housing 10 comprising a cylindrical outer wall 15 and a cylindrical inner wall 20. Cylindrical outer wall 15 and cylindrical inner wall 20 are coaxial with one another, but spaced from one another, so as to be separated by a gap 25. The proximal ends of cylindrical outer wall 15 and cylindrical inner wall 20 are joined to one another and terminate in a proximal end wall 30. Cylindrical outer wall 15 includes an outwardly-extending distal flange 35 terminating in a distal end surface 40. Cylindrical inner wall 20 includes an inwardly-extending distal flange 45 terminating in a distal end surface 50. Distal end surface 40 outwardly-extending distal flange 35 may be co-planar with distal end surface 50 of inwardly-extending distal flange 45 (FIGS. 8, 10 and 11), or distal end surface 40 of outwardly-extending distal flange 35 may be disposed distal to distal end surface 50 of inwardly-extending distal flange 45 (FIG. 11A). Inwardly-extending distal flange 45 of cylindrical inner wall 20 defines a distal bore 55. Distal bore 55 comprises a plurality of splines 60 which constitute one-half of a splined mount, as will hereinafter be discussed in detail. A pair of handles 65 are mounted to opposing sides of cylindrical outer wall 15.

Figure 12:
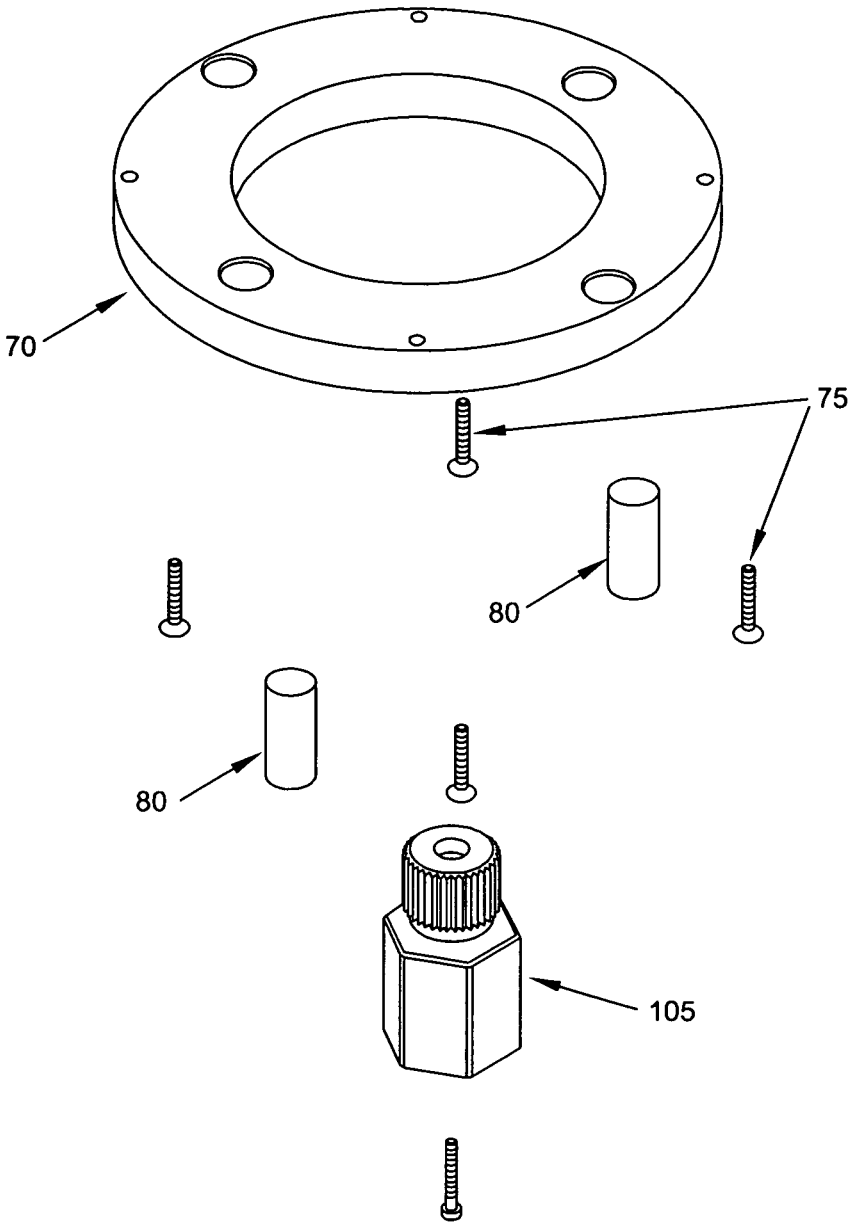
Figure 13:
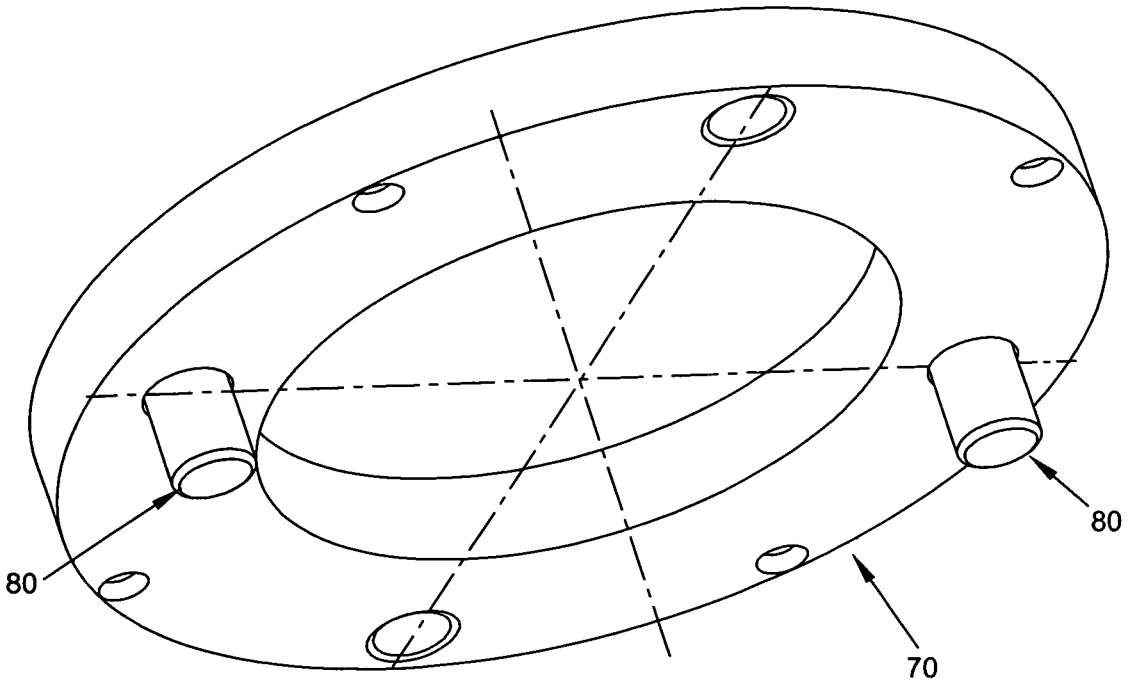
Figure 14:
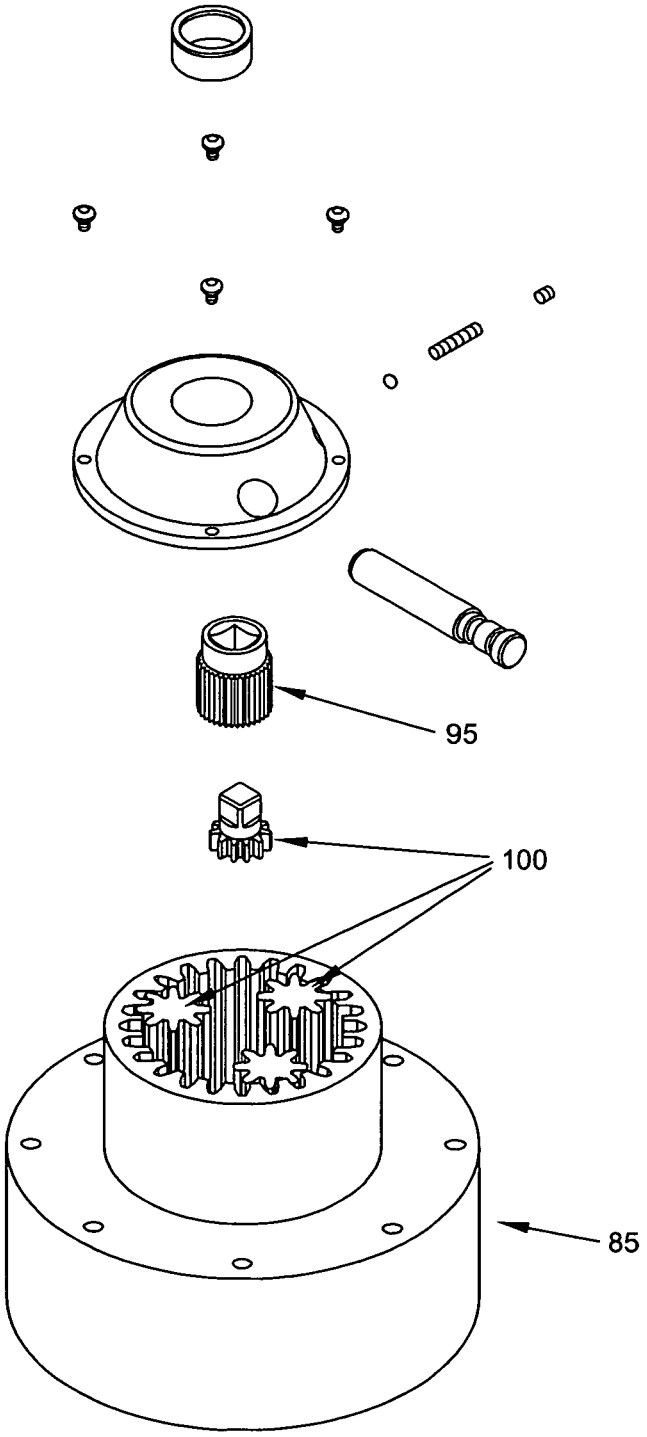
Figure 15:
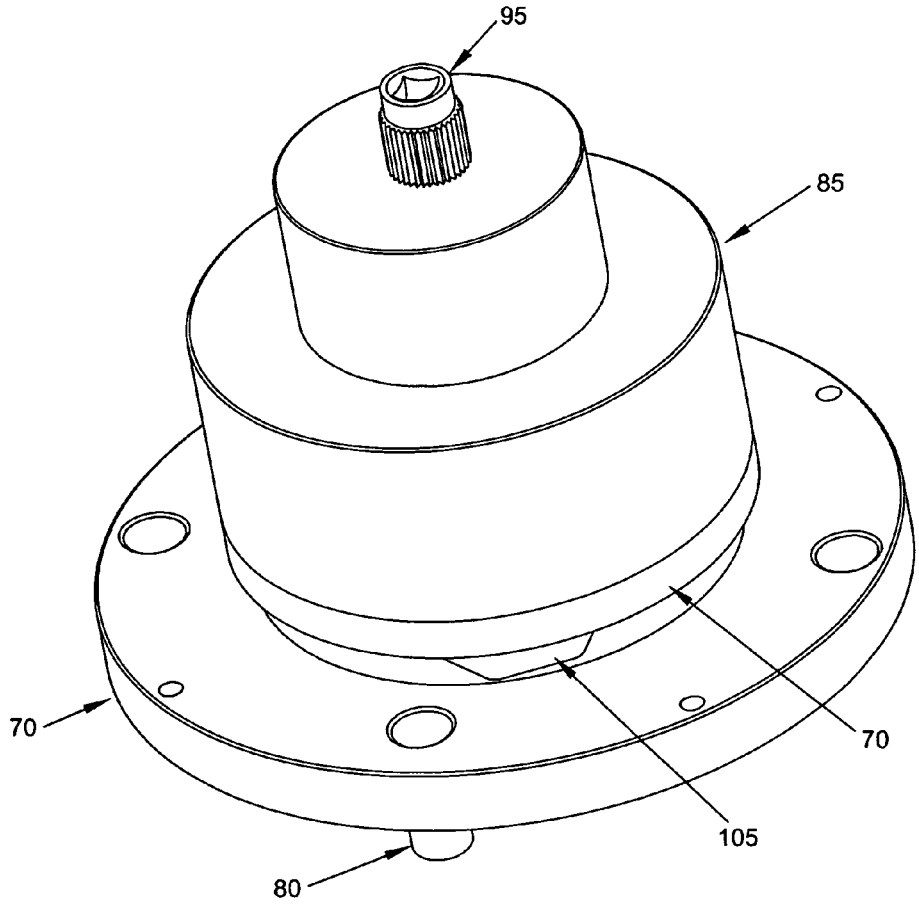
Figure 16:
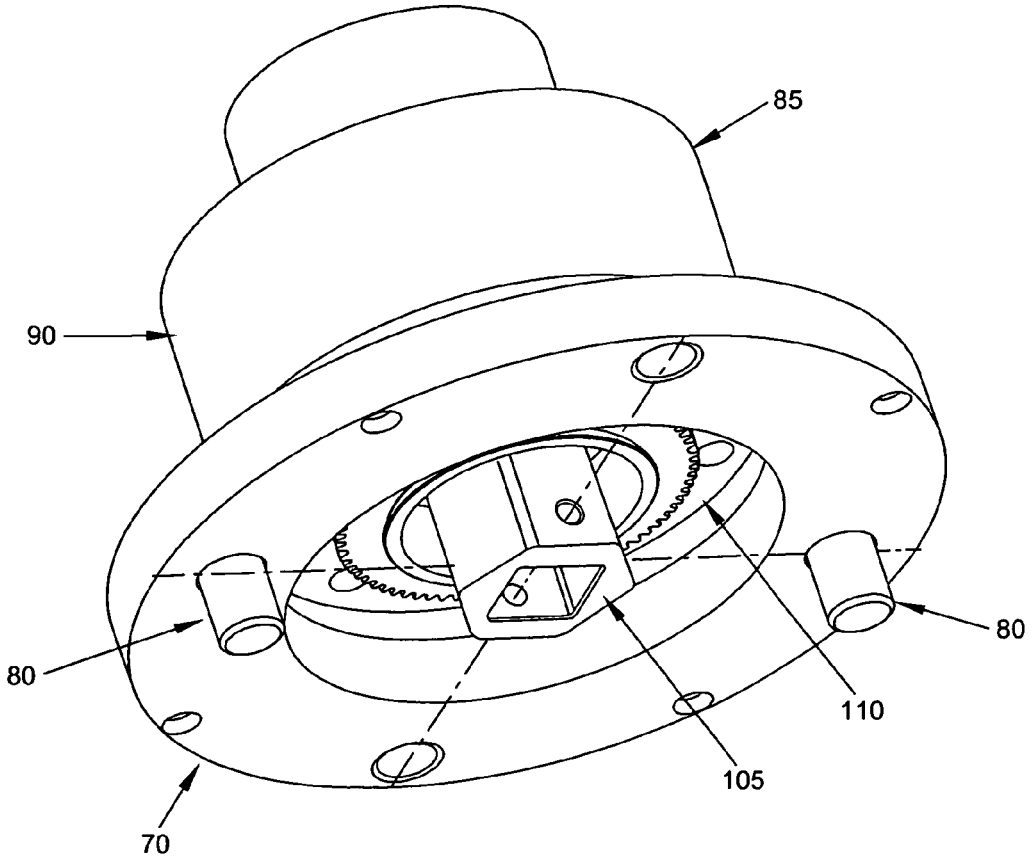
Figure 17:
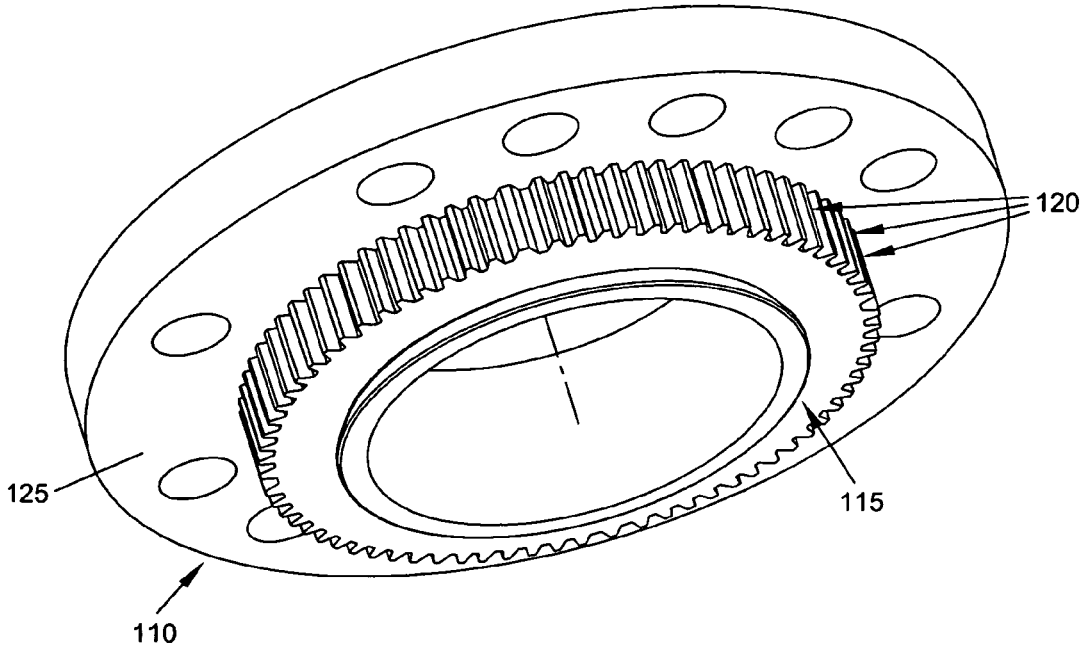

Preferably, and looking now at FIGS. 12 and 13, a universal adapter 70 is mounted to distal end surface 40 of hollow housing 10 via screws 75. Universal adapter 70 includes a plurality of stabilizer pins 80 which stabilize torque wrench 5 against a workpiece housing while torque is applied to a workpiece fastener, as will hereinafter be discussed.

Looking next at FIGS. 5 and 14-17, torque wrench 5 also comprises a mechanical multiplier 85 for amplifying the amount of torque applied to the workpiece fastener. Such mechanical multipliers are well known in the art and will therefore not be discussed in detail herein. However, it will be observed that mechanical multiplier 85 generally comprises a housing 90, a torque input shaft 95, a plurality of internal gears 100, and a torque output shaft 105. Mechanical multiplier 85 is constructed in ways well known in the art so that the amount of torque applied to torque input shaft 95 is amplified at torque output shaft 105. By way of example but not limitation, mechanical multiplier 85 may be constructed with a 25:1 gear ratio, so that 25 revolutions of torque input shaft 95 produce 1 revolution of torque output shaft 105, with a corresponding increase in output torque.

Figure 1:
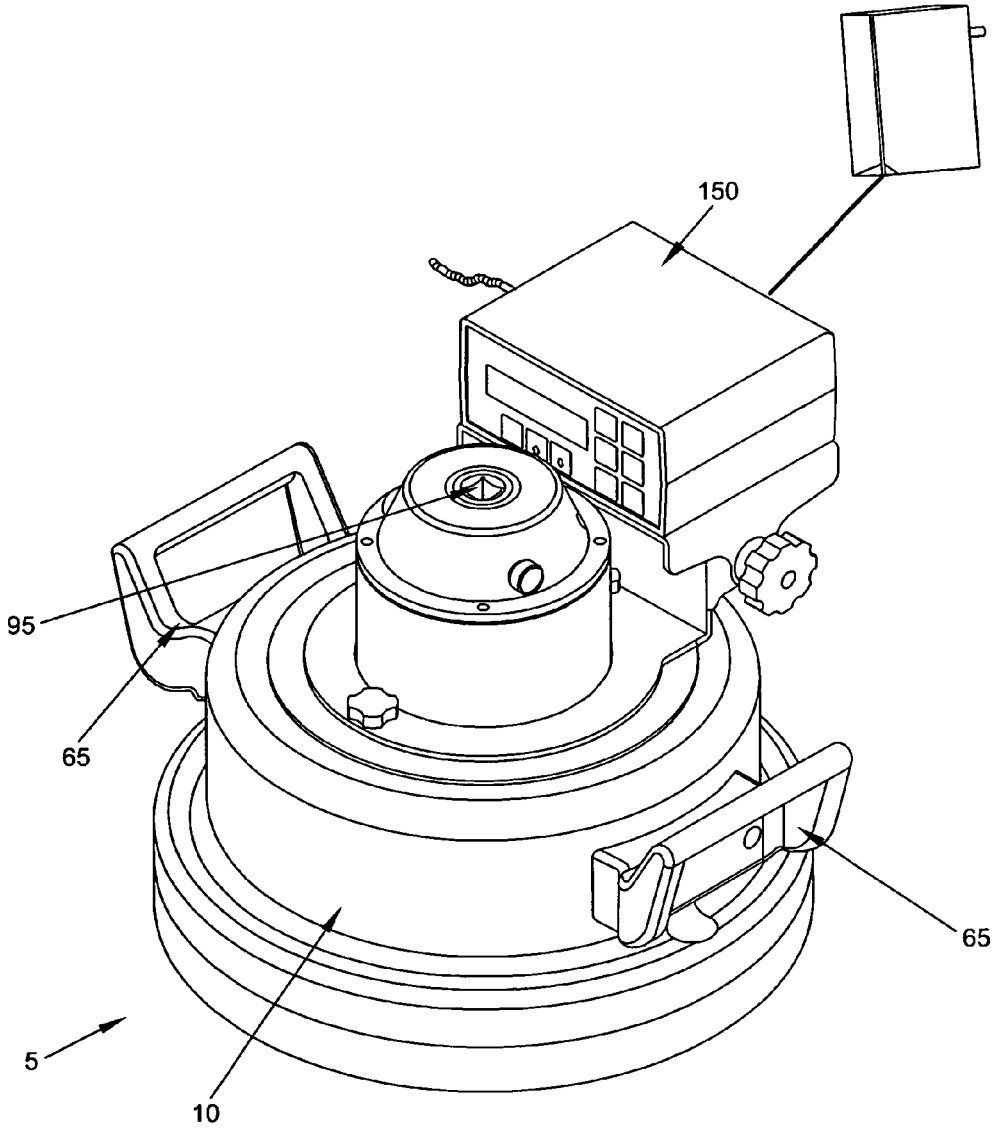
FIGS. 1-4 are schematic views showing a torque wrench formed in accordance with the present invention.
Figure 2:
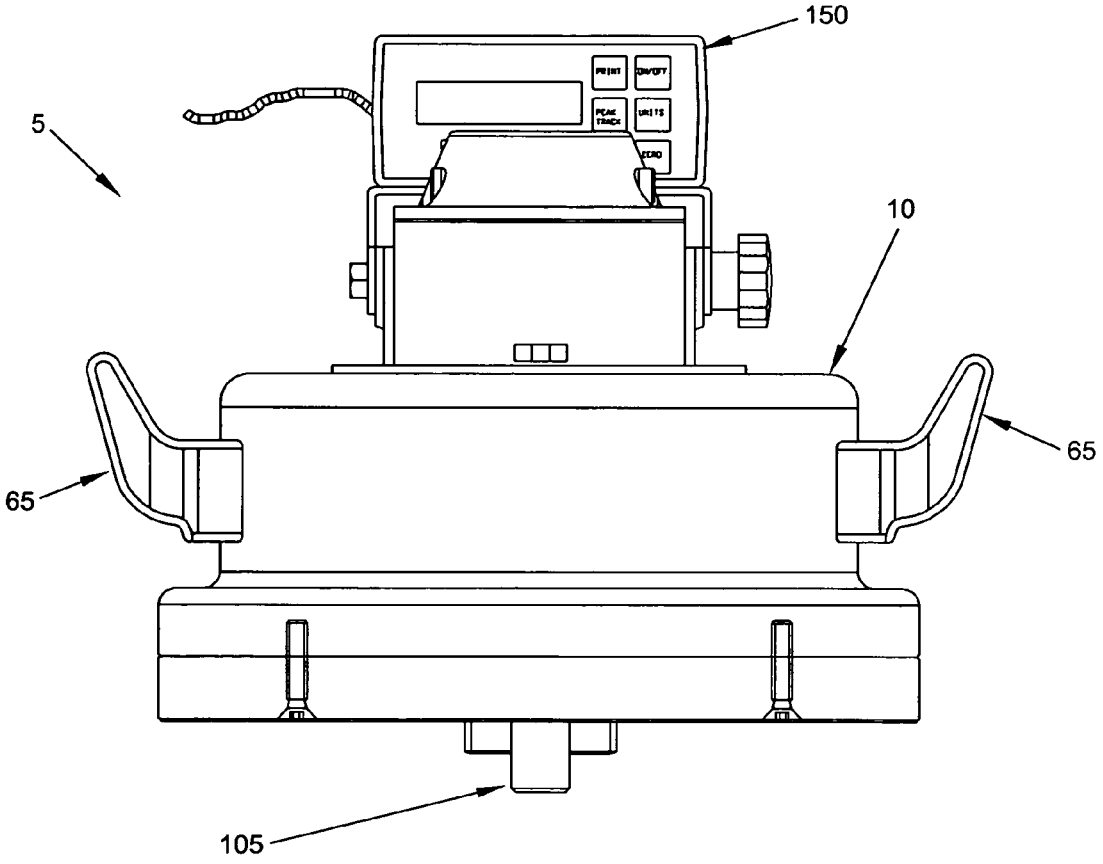
Figure 3:
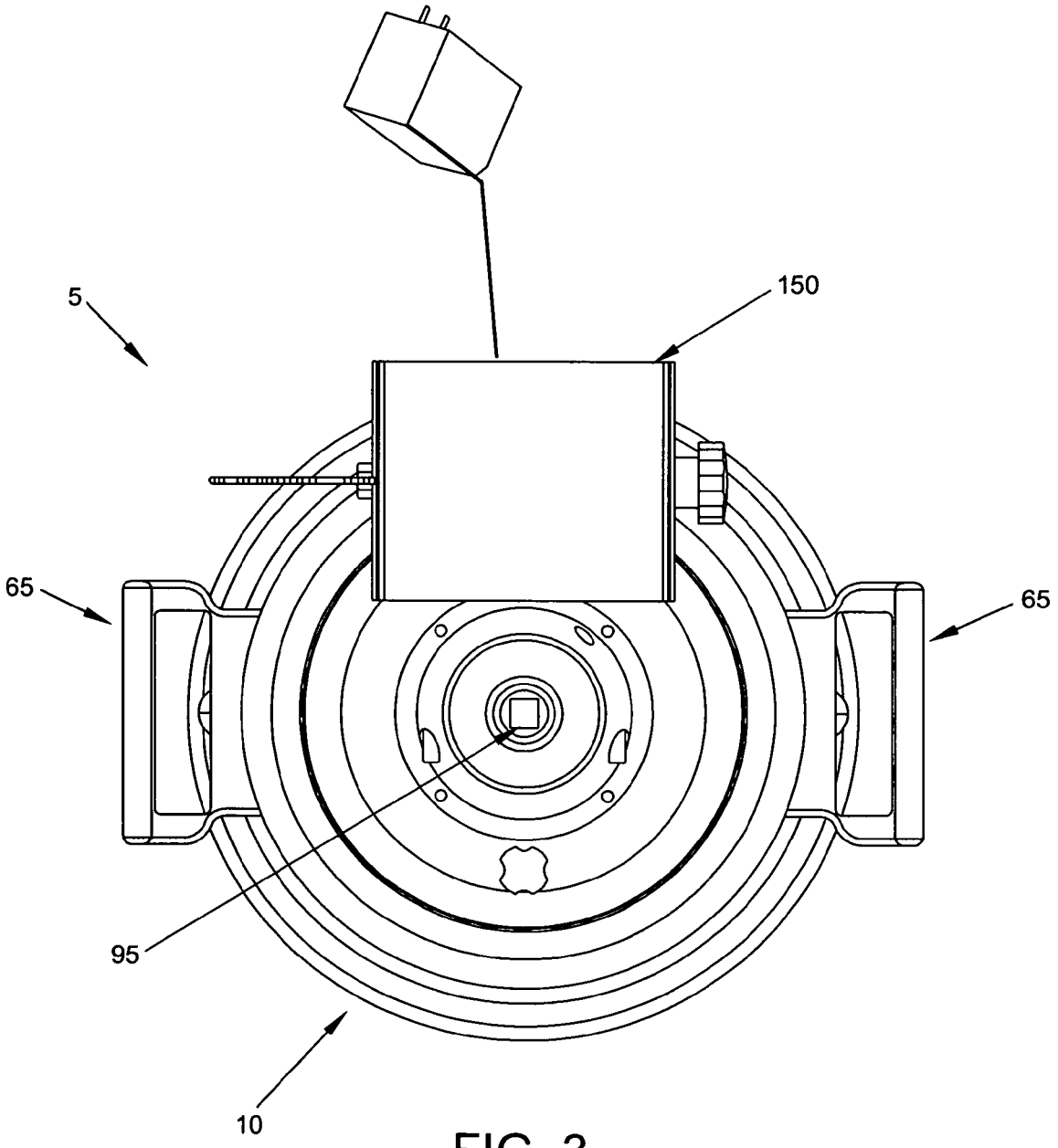
Figure 4:
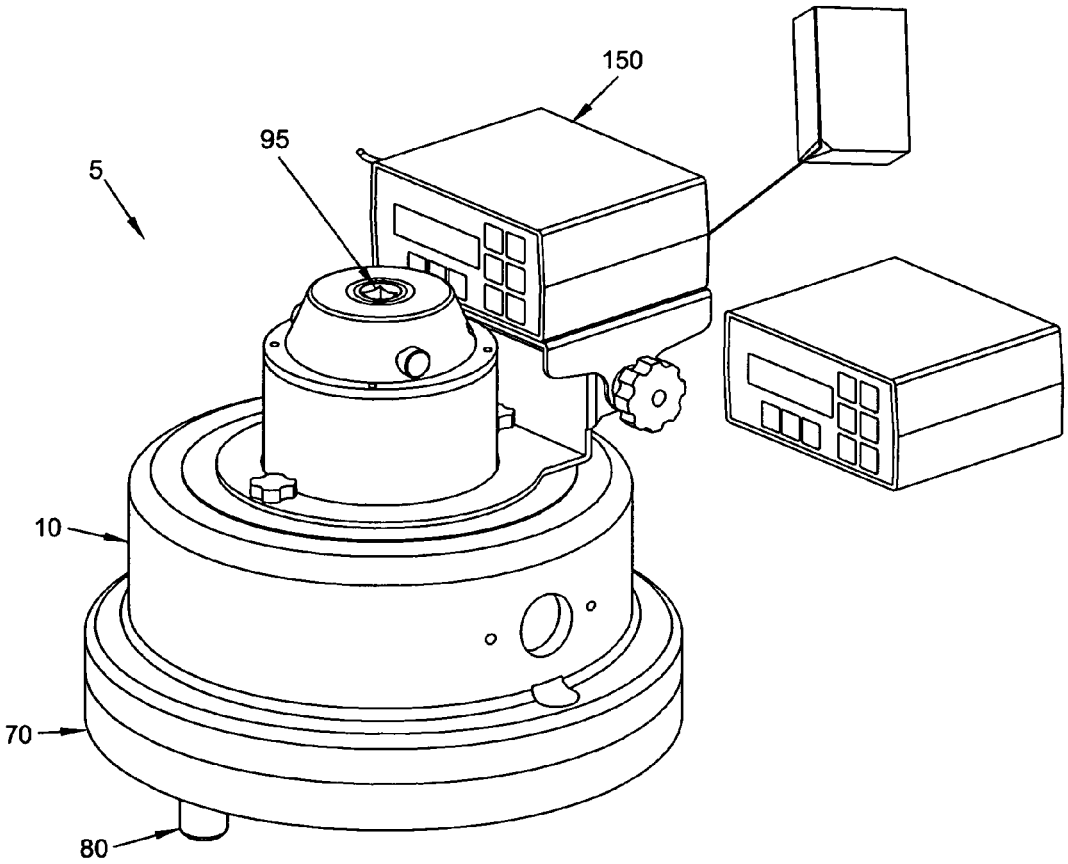
Figure 5:
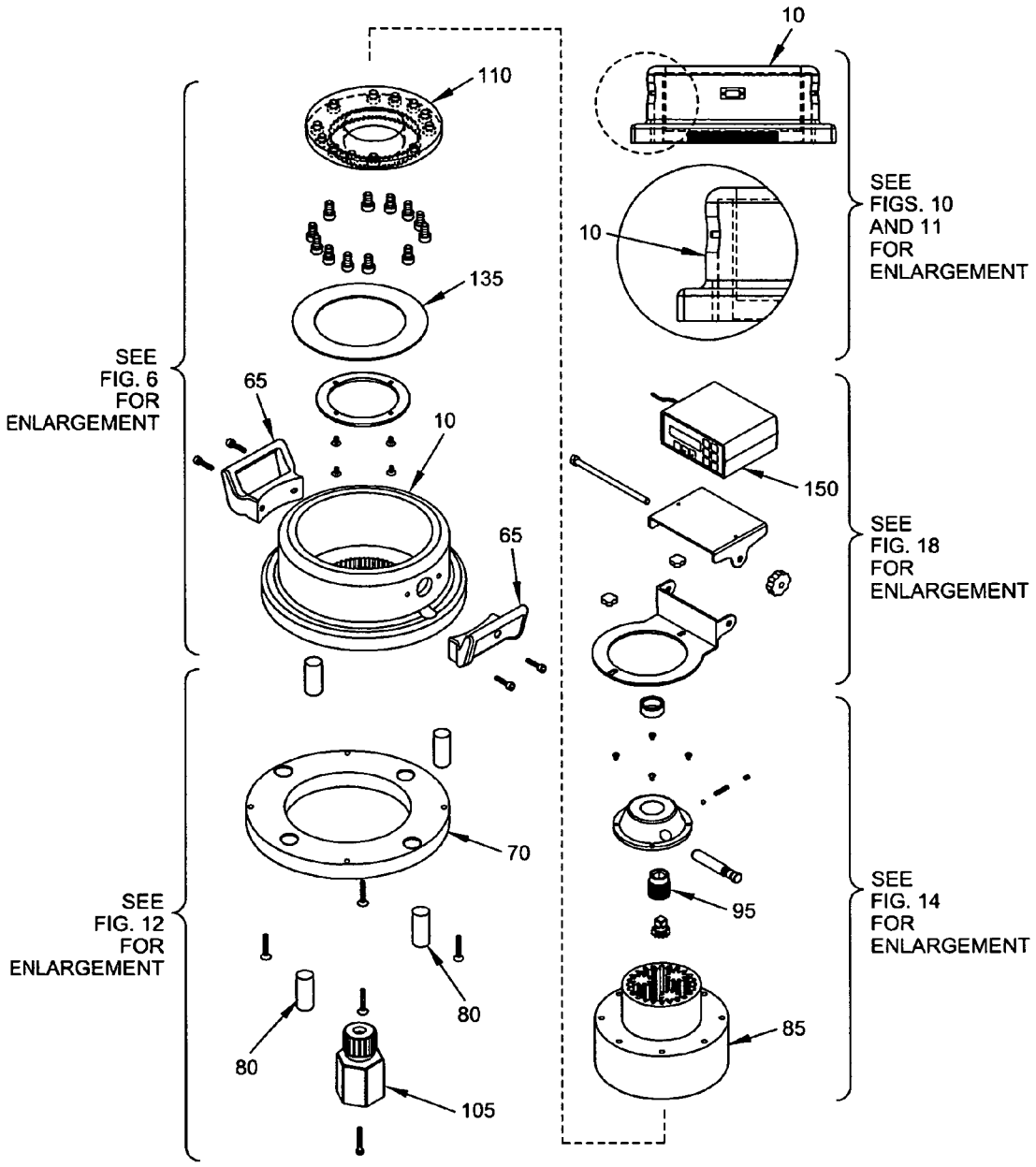
FIG. 5 is a schematic exploded view of the torque wrench shown in FIGS. 1-4.
Figure 6:
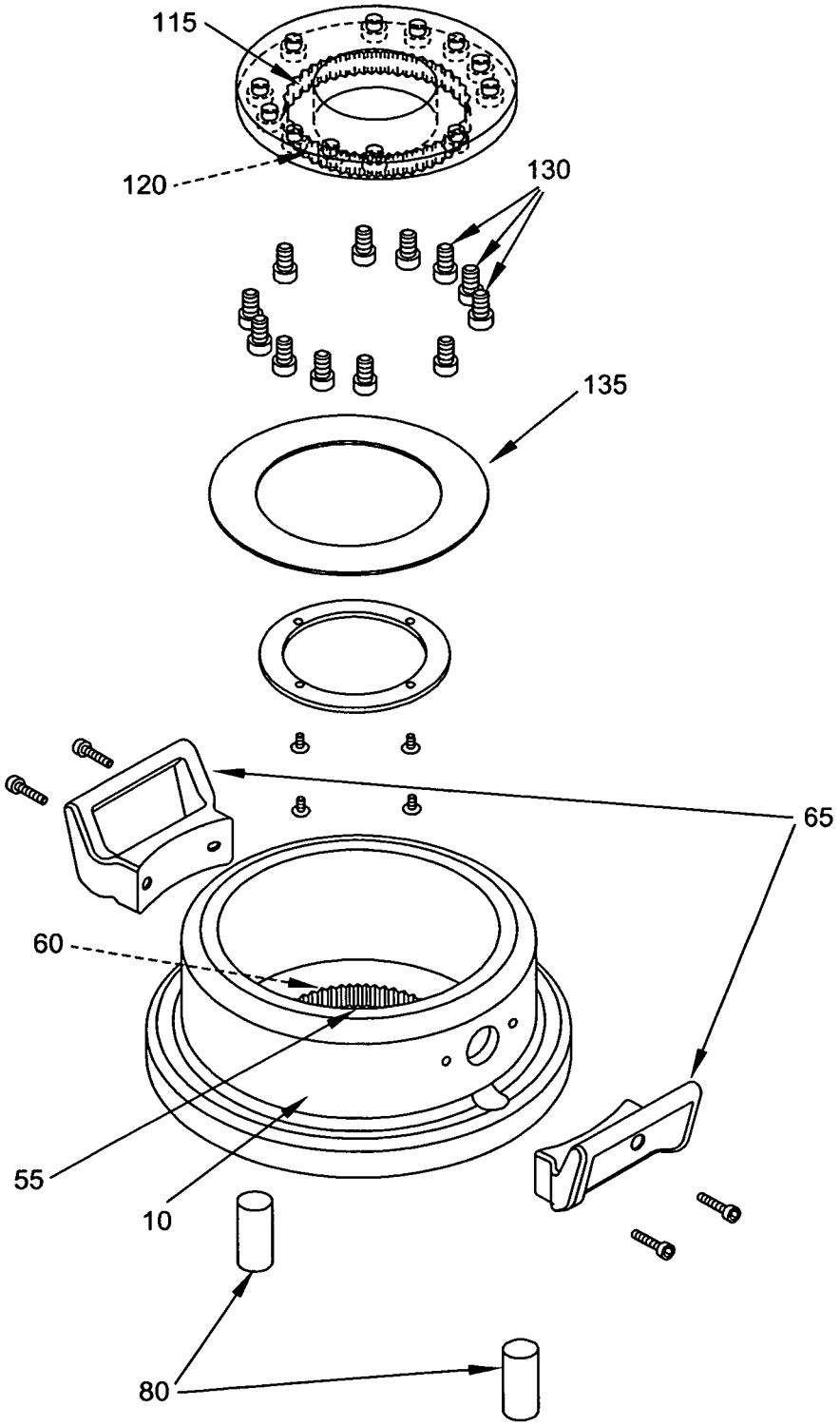
FIGS. 6-11, 11A and 12-18 are schematic views showing further details of the torque wrench shown in FIGS. 1-5.
Figure 7:
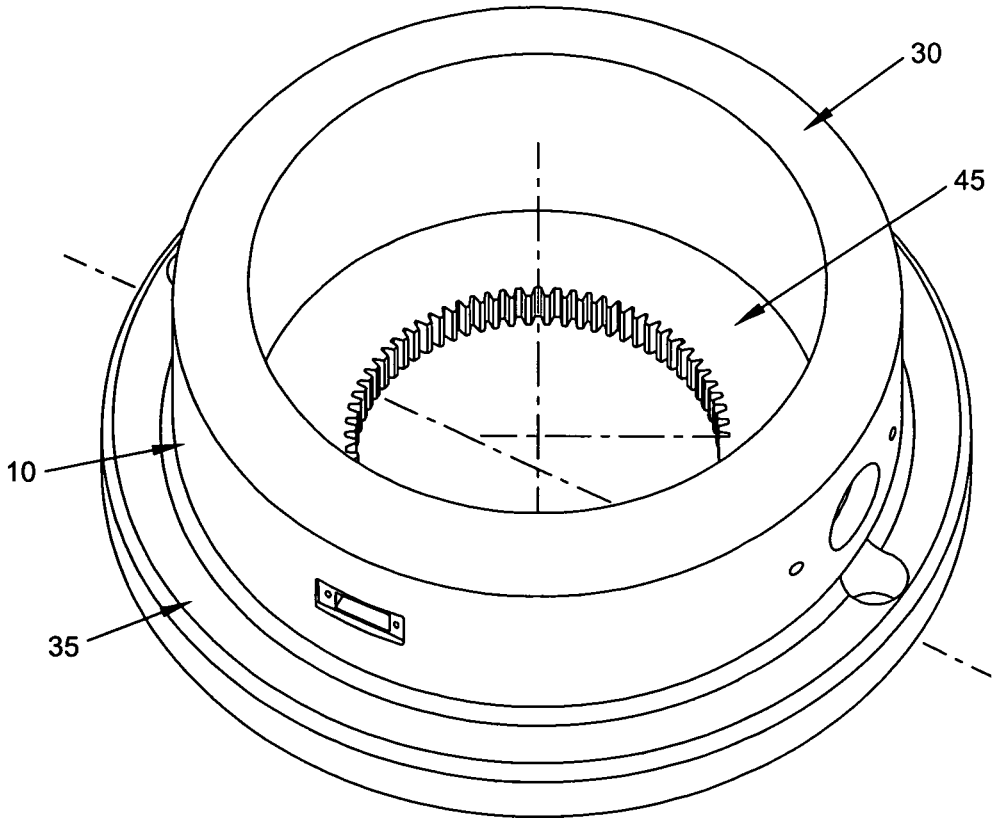
Figure 8:
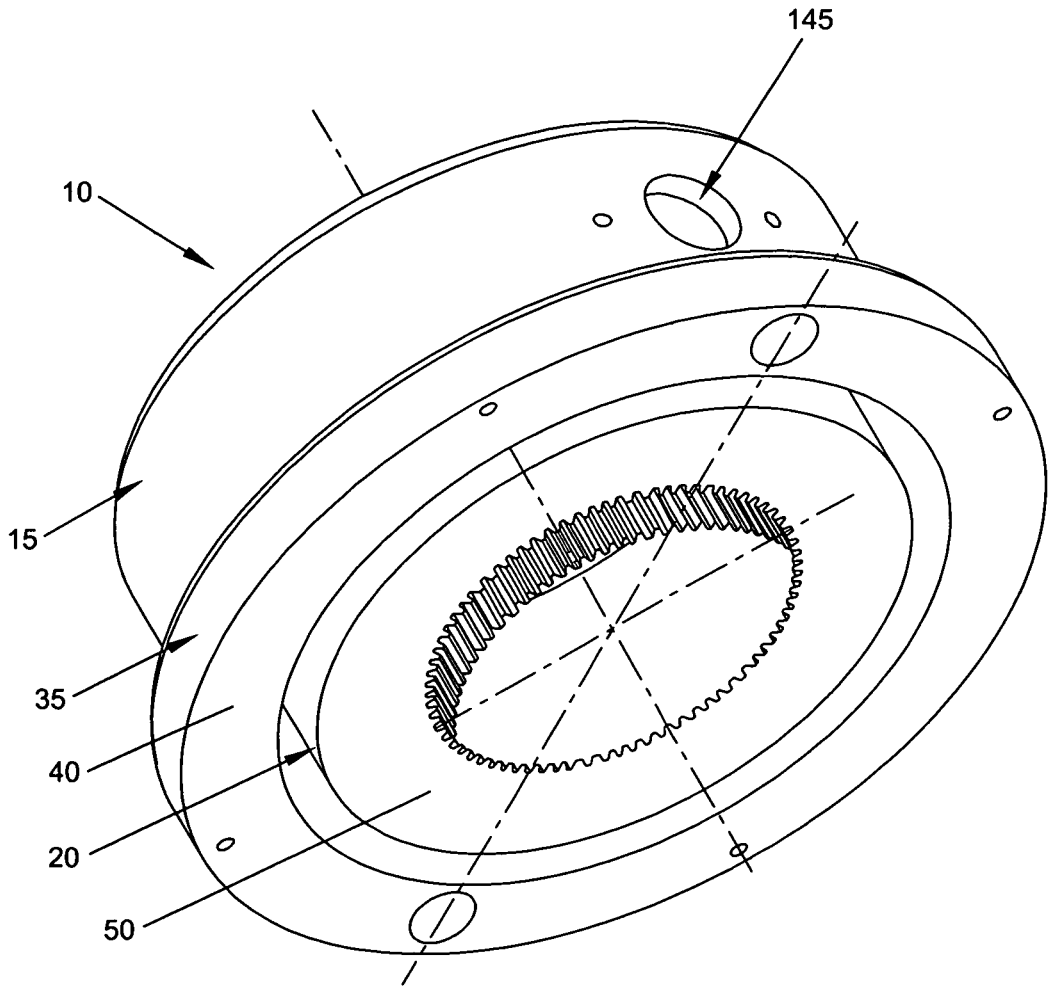
Figure 9:
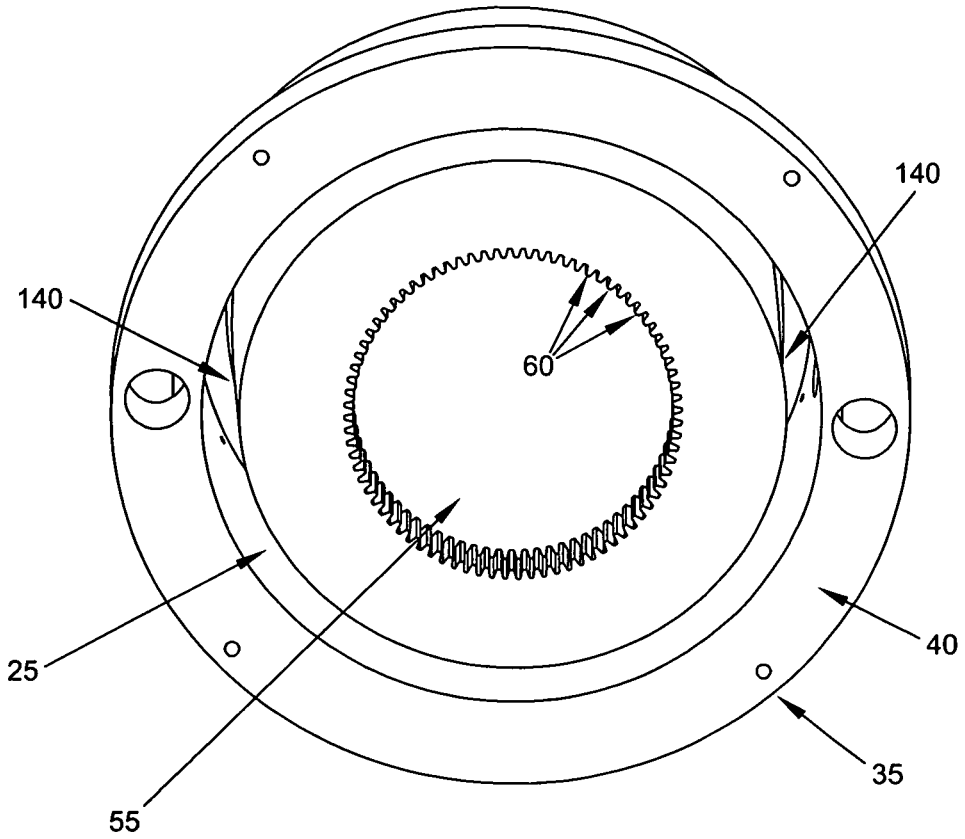
Figure 10:
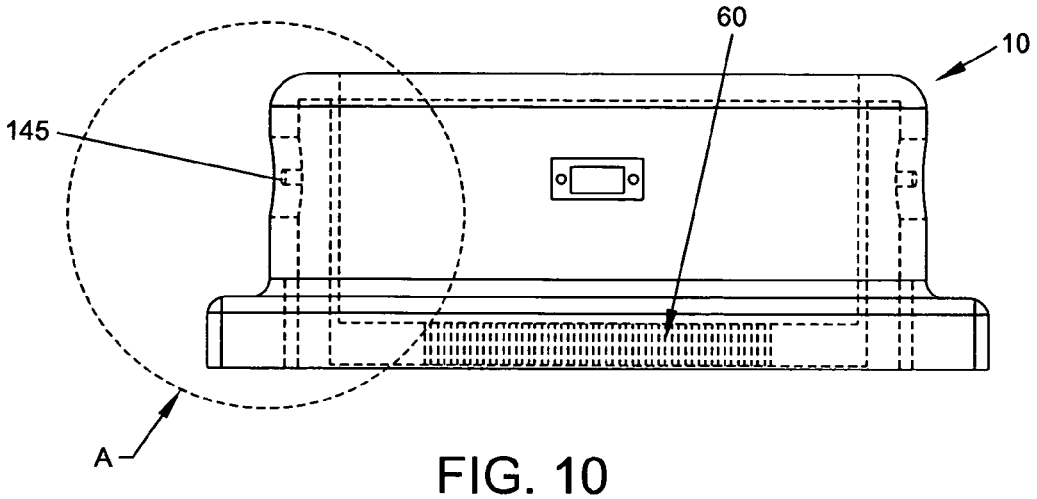

A hollow mount 110 is secured to the distal end of mechanical multiplier 85 whereby to form a "loose-fit, non-binding" connection between mechanical multiplier 85 and hollow housing 10. More particularly, hollow mount 110 comprises a shaft 115 having splines 120 formed thereon. Hollow mount 110 also comprises a flange 125, whereby hollow mount 110 may be mounted to mechanical multiplier 85 via bolts 130 (FIG. 6). Splines 120 on shaft 115 form the second half of a splined mount with the aforementioned splines 60 on hollow housing 10, whereby mechanical multiplier 85 is mounted to hollow housing 10. Significantly, splines 120 on shaft 115 and splines 60 on hollow housing 10 are configured so as to form a "loose-fit, non-binding" mount, i.e., there is a small but perceptible degree of play between the splines. As a result of this construction, there is substantially no binding between mechanical multiplier 85 and hollow housing 10 when hollow housing 10 is secured to a workpiece housing, mechanical multiplier 85 is secured to a workpiece fastener, and torque is applied to the mechanical multiplier. Therefore, substantially no residual forces remain on torque wrench 5 after torque is no longer being applied to the torque wrench, so that there is no "deadband" effect with the new torque wrench, and there is no need to provide a "zero shift" for the torque wrench before changing the direction of applied torque. This is a very significant improvement over the prior art.

Preferably a Teflon slip ring 135 (FIG. 6) is disposed between flange 125 of hollow mount 110 and outwardly-extending distal flange 45 of cylindrical inner wall 20, so as to further eliminate any friction between hollow housing 10 and mechanical multiplier 85.

Figure 18:
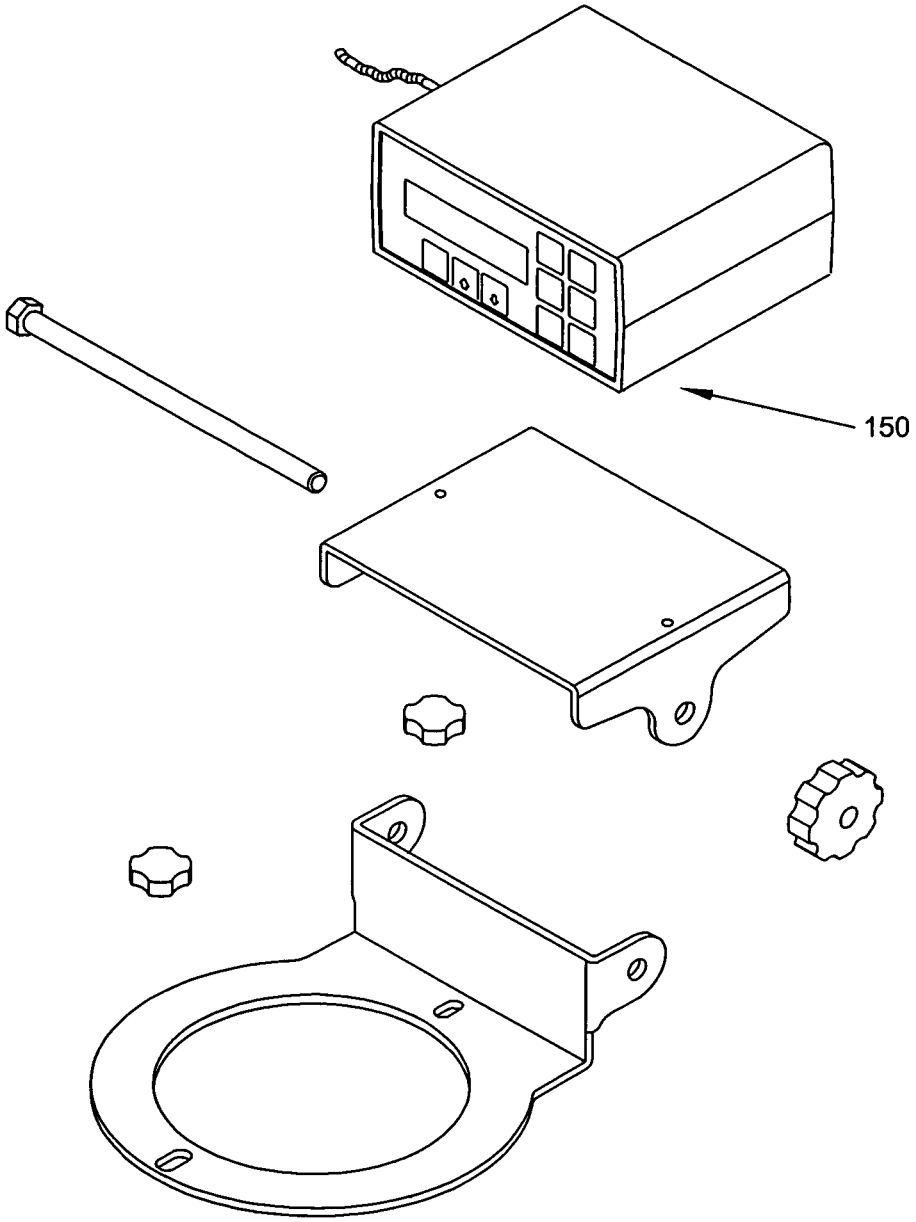

Torque wrench 5 also includes a torque monitoring system to show the operator exactly how much torque is being applied to the fastener. Significantly, the torque wrench of the present invention utilizes an improved construction so as to make the torque monitoring system significantly more accurate than prior art torque wrenches. More particularly, hollow housing 10 is formed with the aforementioned cylindrical inner wall 20 which is concentric with, but spaced from, cylindrical outer wall 15, with a gap 25 being formed between cylindrical outer wall 15 and cylindrical inner wall 20, and with the proximal end of cylindrical inner wall 20 being joined to the proximal end of cylindrical outer wall 15 at proximal end wall 30. One or more strain gauges 140 (FIGS. 9 and 11A) are positioned on cylindrical inner wall 20 so as to measure torque-induced strain imposed on cylindrical inner wall 20. Preferably two diametrically-opposed strain gauges 140 are provided, with each of the strain gauges 140 extending circumferentially on cylindrical inner wall 20 so as to measure torsional deformation of cylindrical inner wall 20. Windows 145 are formed in cylindrical outer wall 15 so as to provide access to strain gauges 140, and electronic controls 150 (FIGS. 5 and 18) are mounted to the torque wrench for reading strain gauge deformation and converting that deformation into a visual display of the torque being applied by the torque wrench.

Significantly, it has now been discovered that improved torque-monitoring accuracy can be achieved by (i) forming hollow housing 10 with a particular construction, and (ii) positioning strain gauges 140 on hollow housing 10 in a particular manner.

More particularly, in order to provide torque wrench 5 with improved torque-monitoring accuracy, cylindrical inner wall 20 is formed with a thickness significantly less than the thickness of cylindrical outer wall 15, whereby to function as a membrane which deforms at a rate which correlates closely to the torque load being imposed on the torque wrench. By way of example but not limitation, for a 1200 ft-lb torque wrench, where housing 10 is formed out of 6061-T651 aluminum, cylindrical inner wall 20 may have a thickness of approximately 0.060 inches and cylindrical outer wall 15 may have a thickness of approximately 0.375 inches. In general, it is preferred that cylindrical outer wall 15 have a thickness which is approximately 5-7 times the thickness of cylindrical inner wall 20. See FIG. 11A.

In addition, in order to provide torque wrench 5 with improved torque-monitoring accuracy, a substantial radius (e.g., 1/16 inch or more) is provided at (i) the intersection of cylindrical inner wall 20 and proximal end wall 30 (see 155 in FIG. 11A), and (ii) the intersection of cylindrical outer wall 15 (see 160 in FIG. 11A). By providing a substantial radius at these joinder locations, it has been found that deformation of cylindrical inner wall 20 more closely correlates to the torque load being imposed on the torque wrench.

Furthermore, in order to provide torque wrench 5 with improved torque-monitoring accuracy, cylindrical inner wall 20 is formed with a very smooth surface finish, e.g., a 32 microfinish or smoother. By providing a cylindrical inner wall 20 with a very smooth surface finish, it has been found that deformation of cylindrical inner wall 20 more closely correlates to the torque load being imposed on the torque wrench.

In addition to the foregoing, it has also been found that, in order to provide torque wrench 5 with improved torque-monitoring accuracy, it is important to position strain gauges 140 on hollow housing 10 in a particular manner. Specifically, it has been found that it is important to position strain gauges 140 above the midpoint, of cylindrical inner wall 20. More particularly, and looking now at FIG. 11A, strain gauges 140 are disposed on cylindrical inner wall 20 so that they reside on the proximal side of a midpoint plane 165, where midpoint plane 165 is defined as the plane lying halfway between the distal surface of proximal end wall 30 and distal end surface 50 of inwardly-extending distal flange 45 of cylindrical inner wall 20.

Significantly, by forming hollow housing 10 with the aforementioned particular construction, and by positioning strain gauges 140 on cylindrical inner wall 20 in the aforementioned manner, the accuracy of the torque monitoring system is greatly improved, particularly at higher torque levels. This is because the portions of cylindrical inner wall 20 being monitored by strain gauges 140 tend to deform at a rate which very closely correlates to the torque load being imposed on the torque wrench. This is a very significant improvement over the prior art.

In use, torque wrench 5 is mounted to a workpiece so that stabilizer pins 80 stabilize torque wrench 5 against a workpiece housing and torque output shaft 105 is mounted to a workpiece fastener. Then torque is applied to torque input shaft 95, causing amplified torque to be applied to torque output shaft 105, which is in turn applied to the workpiece fastener. As this occurs, strain gauges 140 register the amount of strain applied to cylindrical inner wall 20 and electronic controls 150 convert this level of strain into a corresponding level of torque being applied to the workpiece fastener.

Significantly, by forming hollow housing 10 with the aforementioned particular construction, and by positioning strain gauges 140 on cylindrical inner wall 20 in the aforementioned manner, the present invention provides highly accurate torque readings in a substantially linear fashion throughout substantially the full range of the torque wrench, and these readings are of significantly increased accuracy and repeatability throughout that range. This is a very significant improvement over the prior art.

Furthermore, because mechanical multiplier 85 is mounted to hollow housing 10 via a "loose-fit, non-binding" mount (i.e., splines 120 on shaft 115 and splines 60 on hollow housing 10 are configured so as to provide a small but discernible degree of play between the splines), there is substantially no binding between mechanical multiplier 65 and hollow housing 10. Therefore, substantially no residual forces remain on the new torque wrench after torque is no longer being applied to the torque wrench, so that there is no "deadband" effect with the new torque wrench, and there is no need to provide a "zero shift" before changing the direction of applied torque. This is also a very significant improvement over the prior art.

Thus, the present invention provides a novel torque wrench combining "deadband" elimination with improved torque monitoring. The present invention provides highly accurate torque readings in a substantially linear fashion throughout substantially the full range of the torque wrench, and these readings are of significantly increased accuracy and repeatability throughout that range. By way of example but not limitation, a torque wrench formed in accordance with the present invention is typically accurate to + or −1% at low torque levels (e.g., 100 ft-lbs) and accurate to + or −1% at high torque levels (e.g., 1000 ft-lbs). This is a dramatic improvement over the prior art.

MODIFICATIONS

While the present invention has been described in terms of certain exemplary preferred embodiments, it will be readily understood and appreciated by those skilled in the art that it is not so limited, and that many additions, deletions and modifications may be made to the preferred embodiments discussed herein without departing from the scope of the invention.

Thus, for example, while the preferred embodiment of the invention uses the aforementioned loose, non-binding spline connection to provide the loose, non-binding connection between the mechanical multiplier and the inner wall of the hollow housing, this construction may be replaced by a generally equivalent construction. By way of example but not limitation, the loose, non-binding spline connection of the preferred embodiment may be replaced by a loose bolt connection (e.g., where bolts are used to connect the mechanical multiplier to the hollow housing, with the bolt being passed through oversized holes in either the mechanical multiplier or the inner wall of the hollow housing, or both, and with the bolt being loosely connected to the mechanical multiplier or to the inner wall of the hollow housing, or both, for example, with a loosely-tightened nut). The present invention is intended to encompass this and other constructions within the spirit of the present invention.

What is claimed is:

1. A torque wrench comprising:

a hollow housing comprising a cylindrical outer wall having a proximal end and a distal end, and a cylindrical inner wall having a proximal end and a distal end, said cylindrical inner wall being spaced from said cylindrical outer wall so as to provide a cylindrical gap therebetween, said proximal end of said cylindrical outer wall being connected to said proximal end of said cylindrical inner wall, and said distal end of said cylindrical outer wall being configured to engage a workpiece housing;

a mechanical multiplier disposed within said cylindrical inner wall of said hollow housing, said mechanical multiplier comprising a torque input shaft and a torque output shaft, said mechanical multiplier being connected to said cylindrical inner wall of said hollow housing, and said torque output shaft being configured to engage a workpiece fastener; and a torque monitoring system comprising at least one strain gauge mounted to said cylindrical inner wall of said hollow housing proximally of the midpoint of said cylindrical inner wall;

wherein said at least one strain gauge extends circumferentially along said cylindrical inner wall of said hollow housing.

2. A torque wrench according to claim 1 wherein said cylindrical outer wall has a thickness which is approximately 5-7 times the thickness of said cylindrical inner wall.

3. A torque wrench according to claim 1 wherein said proximal end of said cylindrical inner wall is connected to said proximal end of said cylindrical outer wall by a proximal end wall, and further wherein a substantial radius is provided where said cylindrical outer wall joins said proximal end wall, and a substantial radius is provided where said cylindrical inner wall joins said proximal end wall.

4. A torque wrench according to claim 1 wherein said cylindrical inner wall is formed with a smooth surface finish.

5. A torque wrench according to claim 4 wherein said cylindrical inner wall is formed with a surface finish of 32 microfinish or smoother.

6. A torque wrench according to claim 1 wherein said cylindrical outer wall of said hollow housing has at least one opening aligned with said at least one strain gauge mounted to said cylindrical inner wall of said hollow housing.

7. A method for applying torque to a workpiece fastener disposed adjacent to a workpiece housing, the method comprising:

providing a torque wrench comprising:

a hollow housing comprising a cylindrical outer wall having a proximal end and a distal end, and a cylindrical inner wall having a proximal end and a distal end, said cylindrical inner wall being spaced from said cylindrical outer wall so as to provide a cylindrical gap therebetween, said proximal end of said cylindrical outer wall being connected to said proximal end of said cylindrical inner wall, and said distal end of said cylindrical outer wall being configured to engage a workpiece housing;

a mechanical multiplier disposed within said cylindrical inner wall of said hollow housing, the mechanical multiplier comprising a torque input shaft and a torque output shaft, said mechanical multiplier being connected to said cylindrical inner wall of said hollow housing, and said torque output shaft being configured to engage a workpiece fastener; and a torque monitoring system comprising at least one strain gauge mounted to said cylindrical inner wall of said hollow housing proximally of the midpoint of said cylindrical inner wall;

mounting said torque wrench to the workpiece so that said distal end of said cylindrical outer wall of said housing engages a workpiece housing, and said torque output shaft of said mechanical multiplier engages a workpiece fastener;

applying torque to said torque input shaft of said mechanical multiplier; and using said at last one strain gauge to measure the torque applied to the workpiece fastener by said torque wrench;

wherein torque is applied to said torque input shaft of said mechanical multiplier in a first direction and then, without performing a zero shift, torque is applied to said torque input shaft of said mechanical multiplier in a second direction.

8. A method according to claim 7 wherein said cylindrical outer wall has a thickness which is approximately 5-7 times the thickness of said cylindrical inner wall.

9. A method according to claim 7 wherein said proximal end of said cylindrical inner wall is connected to said proximal end of said cylindrical outer wall by a proximal end wall, and further wherein a substantial radius is provided where said cylindrical outer wall joins said proximal end wall, and a substantial radius is provided where said cylindrical inner wall joins said proximal end wall.

10. A method according to claim 7 wherein said cylindrical inner wall is formed with a smooth surface finish.

11. A method according to claim 10 wherein said cylindrical inner wall is formed with a surface finish of 32 microfinish or smoother.

12. A method according to claim 7 wherein said cylindrical outer wall of said hollow housing has at least one opening aligned with said at least one strain gauge mounted to said cylindrical inner wall of said hollow housing.

13. A method according to claim 7 wherein said at least one strain gauge extends circumferentially along said cylindrical inner wall of said hollow housing.

* * * * *